US006454133B1

(12) United States Patent
Lopez et al.

(10) Patent No.: US 6,454,133 B1
(45) Date of Patent: Sep. 24, 2002

(54) TOOTHPASTE BUTLER

(76) Inventors: Kenneth Oscar Lopez, 3518 W. 66th St., Chicago, IL (US) 60629; Jason Frank Beneavides, 5024 S. Knox, Chicago, IL (US) 60632

( * ) Notice: Subject to any disclaimer, the term of this patent is extended or adjusted under 35 U.S.C. 154(b) by 0 days.

(21) Appl. No.: 09/848,452

(22) Filed: May 3, 2001

(51) Int. Cl.[7] ..... B65D 35/28

(52) U.S. Cl. ..... 222/102; 222/105; 222/94; 222/95

(58) Field of Search ..... 222/102, 101, 222/105, 94, 95, 97

(56) References Cited

U.S. PATENT DOCUMENTS

| | | | | | |
|---|---|---|---|---|---|
| 2,530,327 | A | * | 11/1950 | Derrick | 222/101 |
| 2,670,876 | A | | 3/1954 | Clouse | 222/102 |
| 2,876,934 | A | * | 3/1959 | Brim | 222/102 |
| 3,197,072 | A | | 7/1965 | Dick | 222/102 |
| 4,019,655 | A | | 4/1977 | Moeller | 222/96 |
| 4,337,879 | A | * | 7/1982 | Park | 222/102 |
| 5,195,659 | A | * | 3/1993 | Eiskant | 222/102 |
| 5,397,030 | A | | 3/1995 | Williams | 222/96 |
| 5,441,172 | A | | 8/1995 | Yu | 222/52 |
| D368,612 | S | | 4/1996 | Amin | D6/541 |
| 5,676,279 | A | * | 10/1997 | Bastion | 222/102 |
| 5,848,730 | A | * | 12/1998 | Kawase et al. | 132/219 |

FOREIGN PATENT DOCUMENTS

| | | | | |
|---|---|---|---|---|
| EP | 0497124 A1 | * | 1/1992 | B65D/35/28 |

* cited by examiner

*Primary Examiner*—Lesley D. Morris
*Assistant Examiner*—Stephanie Willatt
(74) *Attorney, Agent, or Firm*—Welsh & Katz, Ltd.; Eric D. Cohen

(57) ABSTRACT

An apparatus is provided for discharging toothpaste from a toothpaste tube under control of a user. The apparatus includes a tube holder and a tube receptacle disposed within a first end of the tube holder and adapted to accept a cap end of the toothpaste tube. The apparatus further includes a set of nip rolls adapted to engage a body of the toothpaste tube and to urge toothpaste from a distal end of the toothpaste tube towards the cap end and a wheeled trolley coupled to the nip rolls on a first end and engaging a guide channel of the tube holder on a second end and adapted to maintain an alignment of the nip rolls with respect to a centerline of the tooth paste tube as the nip rolls travel along a longitudinal axis of the toothpaste tube from the distal end to the cap end.

18 Claims, 5 Drawing Sheets

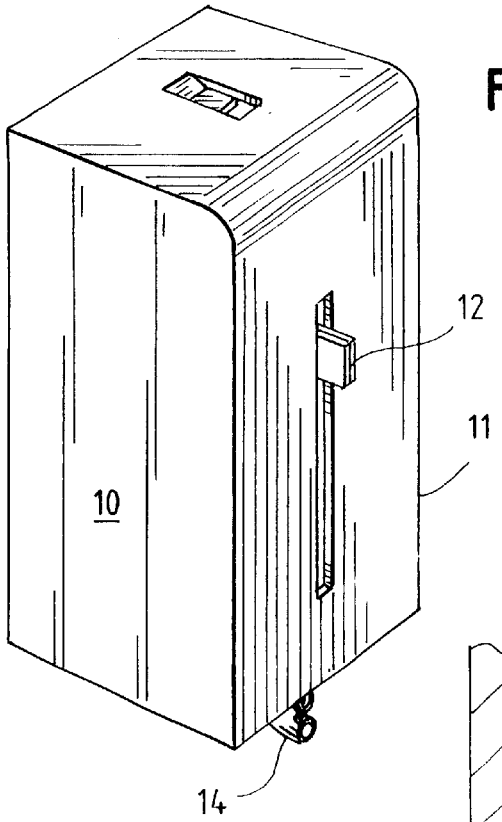
FIG. 1
FIG. 2
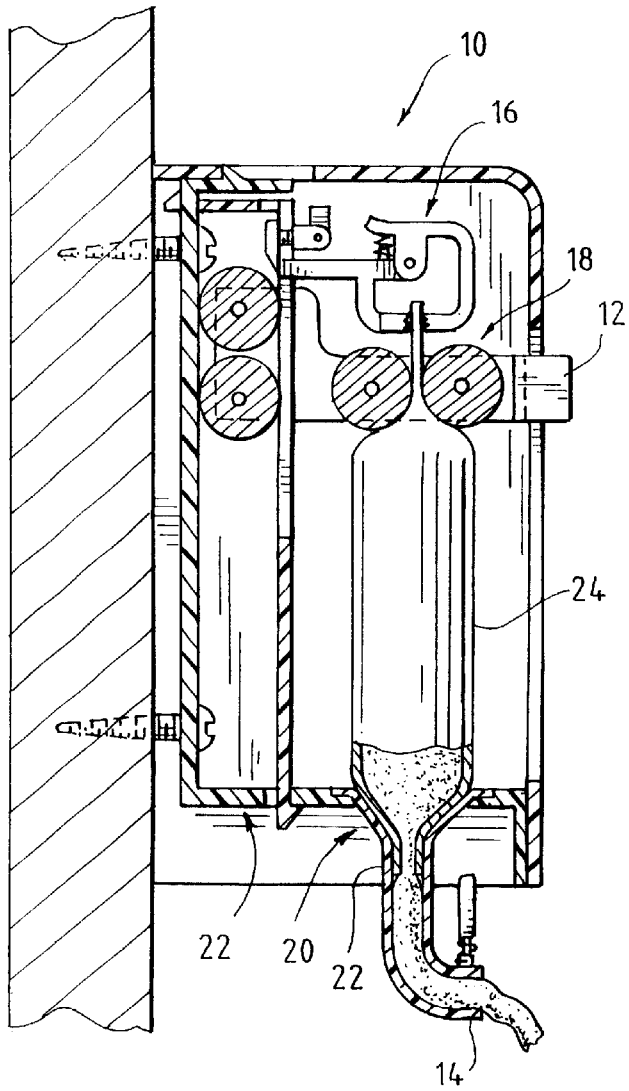

TOOTHPASTE BUTLER

FIELD OF THE INVENTION

The invention relates to oral hygiene and more particularly to toothpaste dispensers.

BACKGROUND OF THE INVENTION

Devices for dispensing toothpaste from toothpaste tubes are generally known. Such devices may typically be divided into ratcheting-type devices and gear driven devices.

Of the ratcheting-type devices, a first type provides a stationary lower portion and a movable upper portion. Moveably disposed within the upper portion is a slide assembly which pushes toothpaste out of the toothpaste tube using an internal pair of rollers disposed against each side of the toothpaste tube and which press against the tube from either side.

The lower portion accepts the cap end of the toothpaste tube. As the moveable upper portion is pressed down, a set of pawls on the slide assembly engage the upper portion and move downwards with the upper portion, pushing the rollers downward thereby dispensing toothpaste. As the upper portion is released, the pawls release and the upper portion moves upwards As an alternative to the ratcheting-type devices, a number of gear driven devices have been proposed. Generally the gear driven devices also provide a pair of rollers on each side of the toothpaste tube, which squeeze and advance towards a cap end, thereby, dispensing toothpaste. A gear-drive engages a housing and functions to drive the rollers along the toothpaste tube.

While the prior art devices have been effective, they are typically overly complicated and difficult to manufacture. The need for ratchet or gear-driven racks require overly complicated housing and engagement features. Accordingly, a need exists for an apparatus of dispensing toothpaste from a toothpaste tube which is simple to manufacture and reliable in design.

SUMMARY OF THE INVENTION

An apparatus is provided for discharging toothpaste from a toothpaste tube under control of a user. The apparatus includes a tube holder and a tube receptacle disposed within a first end of the tube holder and adapted to accept a cap end of the toothpaste tube. The apparatus further includes a set of nip rolls adapted to engage a body of the toothpaste tube and to urge toothpaste from a distal end of the toothpaste tube towards the cap end and a wheeled trolley coupled to the nip rolls on a first end and engaging a guide channel of the tube holder on a second end and adapted to maintain an alignment of the nip rolls with respect to a centerline of the tooth paste tube as the nip rolls travel along a longitudinal axis of the toothpaste tube from the distal end to the cap end.

BRIEF DESCRIPTION OF THE DRAWINGS

FIG. 1 depicts a toothpaste dispenser in accordance with an illustrated embodiment of the invention;

FIG. 2 depicts a side cut-away view of the dispenser of FIG. 1;

DETAILED DESCRIPTION OF A PREFERRED EMBODIMENT

Figure 3A:
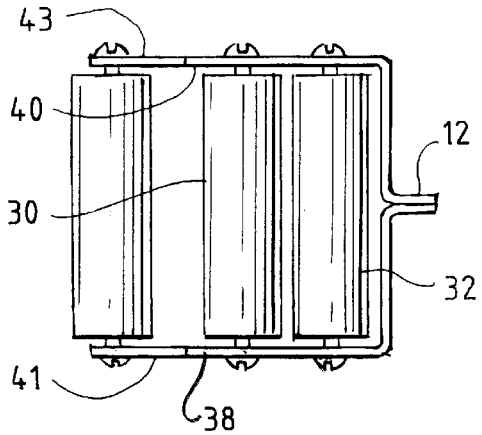
FIG. 3 depicts details of a wheeled trolley of the dispenser of FIG. 1.

FIG. 1 is a perspective view of an apparatus 10 for dispensing toothpaste from a toothpaste tube in accordance with an illustrated embodiment of the invention. Included on the apparatus 10 is an actuating lever 12 for dispensing toothpaste and a discharge orifice 14 for directing toothpaste onto a toothbrush (not shown).

FIG. 2 is a side cut-away view of the dispenser 10 of FIG. 1. Included within the dispenser 10 is a receptacle 20 for a cap end of the toothpaste tube 24. A set of complementary threads 22 may be provided to allow the cap end of the toothpaste tube 24 to be threaded into the dispenser 10.

At an opposing end of the toothpaste tube 24, a clamp assembly 16 is provided. The clamp assembly 16 may be used to secure a distal end of the toothpaste tube 24 within the dispenser.

A wheeled trolley 18 may function to engage a body of the toothpaste tube 24 and urge the toothpaste from the distal end of the toothpaste tube 24 towards the discharge end. A guide channel or slot 22 may be provided to restrain and guide the wheeled trolley 18 as it moves along the toothpaste tube 24.

Figure 3B:
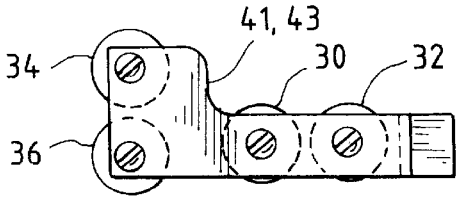
Figure 3C:
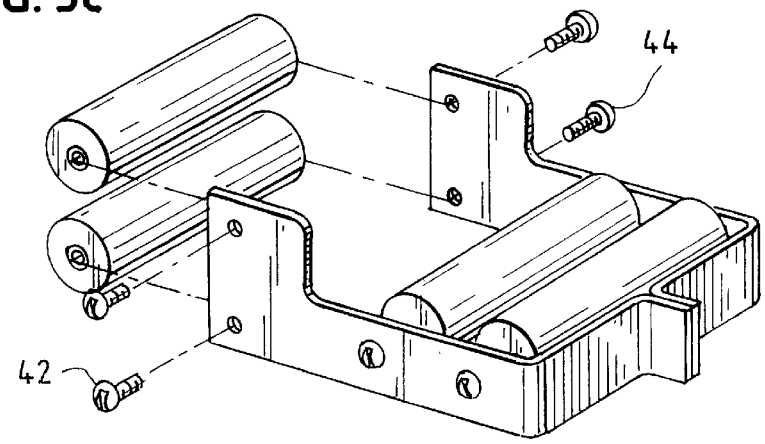
Figure 3D:
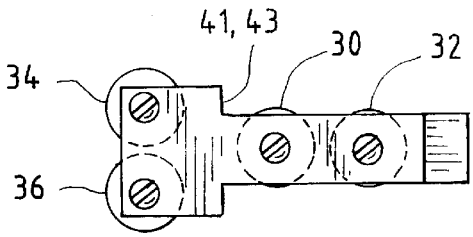

FIGS. 3*a–b* show top and side views of the wheeled trolley 18. FIG. 3*c* shows an exploded, perspective view of the wheeled trolley 18.

As shown, a set of side rails 38, 40 form a frame of the wheeled trolley 18. The guide rails may be laterally aligned and relative straight with two handles 12 or may be joined at a user end through use of a pair of right angle bends as shown in FIG. 3*a*.

Figure 10:
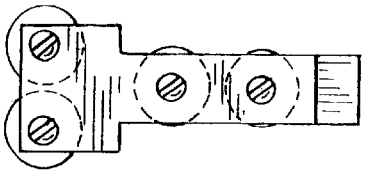
FIG. 10 depicts a set of end rails that may be used with the dispenser of FIG. 1.

Further, each side rail 38, 40 may include an end rail portion 41, 43 set parallel to the toothpaste tube 24 and at right angles to the guide rail 38, 40 as shown in FIG. 3*b*. The end rail 41, 43 may extend in either direction from the end of the side rails 38, 40 or may be centered as shown in FIG. 10.

A first set of rollers 30, 32 form a set of nip rollers, which engage the toothpaste tube 24 as shown in FIG. 1. A second set of rollers 34, 36 engage the guide slot 22. A set of screws 44 are provided to secure each roller 30, 32, 34, 36 to the rails 38, 40, 41, 43.

Figure 4:
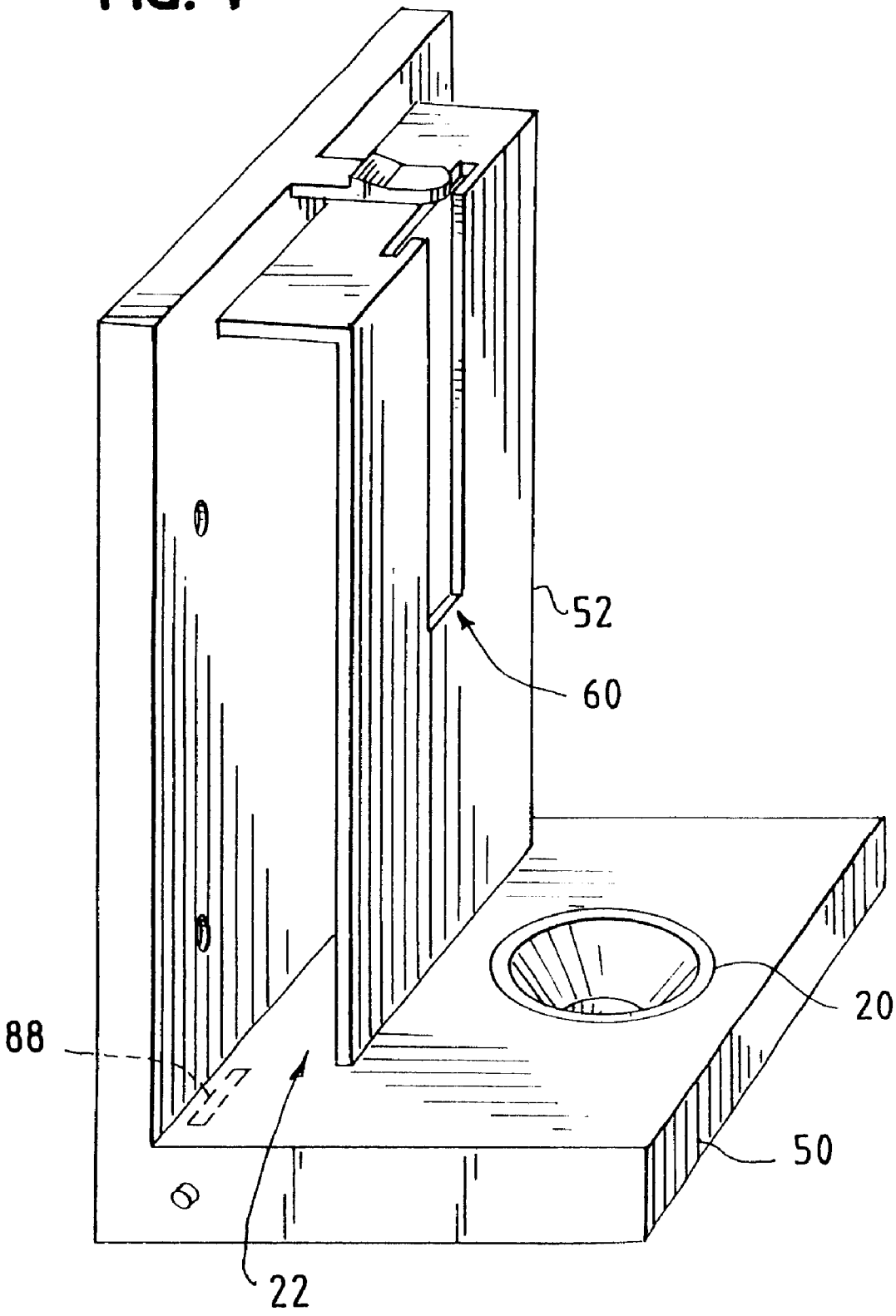
FIG. 4 depicts details of a frame used by the dispenser of FIG. 1.
Figure 9:
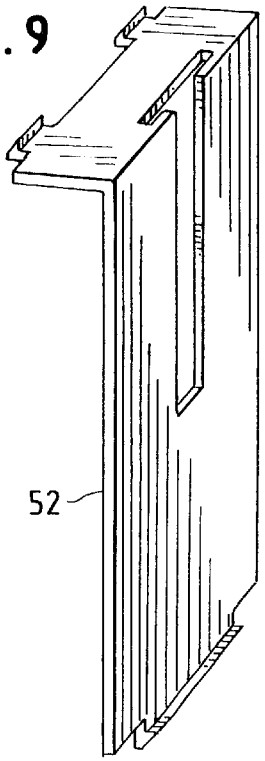
FIG. 9 depicts an angled plate that may be used to form a guide slot within the dispenser of FIG. 1.

FIG. 4 shows the frame 50 and associated support structures of the dispenser 10. As shown, an angled plate 52 (FIG. 9) operating in conjunction with the frame 50 forms the guide slot 22 for the wheeled trolley 18.

Figure 8:
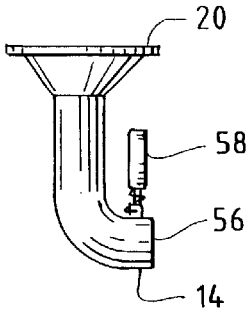
FIG. 8 depicts a toothpaste tube receptacle that may be used with the dispenser of FIG. 1.

The receptacle 20 shown in FIGS. 1, 4 and 8 may be formed as a removable insert. A reclosable cap 56 may act to seal and protect the freshness of any toothpaste within the discharge orifice 14. A spring loaded lever 58 may function to urge the cap 56 into a closed position between periods of use.

Figure 5:
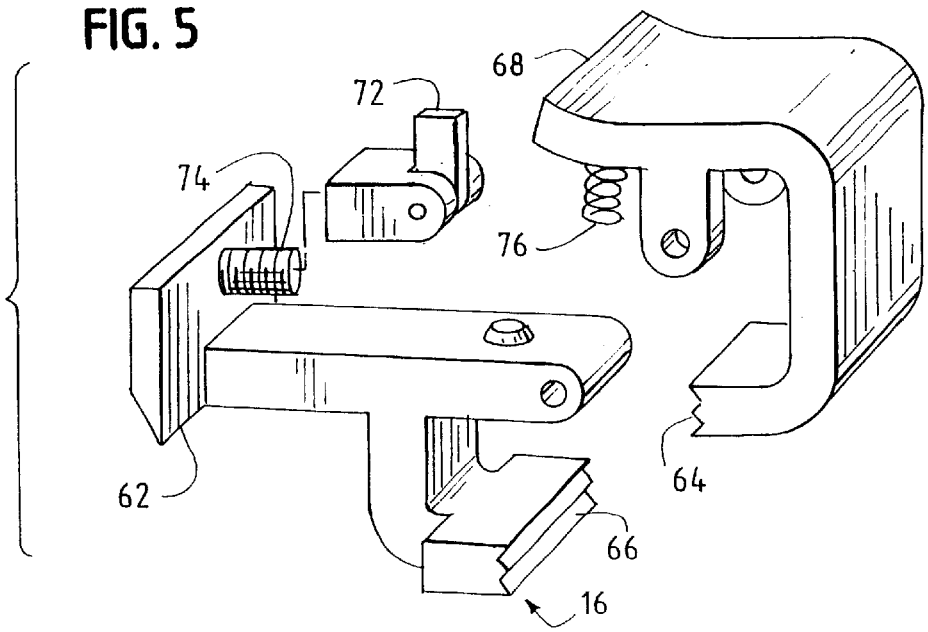
FIG. 5 depicts a clamping assembly used by the dispenser of FIG. 1.

FIG. 5 depicts the clamp assembly 16 of FIG. 1. As shown a flat plate 62 of the clamp assembly 16 is designed to be inserted into, and engage, a T-slot 60 of the angled plate 52. A threaded finger nut 72 may be used to adjust a height of the clamp assembly 16 to accommodate the varying length of different length toothpaste tubes 24.

Also included within the clamp assembly 16 is a stationary jaw 66 and movable jaw 64. A spring 76 disposed beneath a thumb activated portion 68 of the moveable jaw 64 biases the moveable jaw 64 against the distal end of the toothpaste tube 24 retained between the stationary and moveable jaws 64, 66.

The dispenser 10 may be constructed entirely of plastic and assembled without tools. The removable receptacle 20 allows for easy cleaning of the only part 20 making contact with the toothpaste.

To load the dispenser 10 with a toothpaste tube 24, a removable front cover 11 may be lifted off the dispenser 10. The wheeled trolley 18 may be lifted to its uppermost position and the distal end of the tube 24 inserted into the nip rolls 30, 32 as the cap end is rotated into the receptacle 20.

The clamp assembly 16 may be inserted into the T-slot 60 and the jaws 64, 66 may be opened to engage and hold the distal end of the toothpaste tube 24. The cover 11 may then be replaced in preparation for use.

During use, the guide slot rollers 34, 36 and guide rails 38, 40 of the wheeled trolley 18 function to maintain the nip rollers 30, 32 in alignment over a centerline extending along a longitudinal axis of the toothpaste tube 24. Further, the spaced-apart relationship of the guide rollers 34, 36 prevent twisting of the wheeled trolley 18 and reduce friction between the wheeled trolley 18 and the structure of the dispenser 10 as the wheeled trolley 18 advances from the distal end towards the cap end of the toothpaste tube 24. The use of the wheeled trolley 18 has been found to significantly reduce the force needed to dispense toothpaste over prior art devices.

Figure 6:
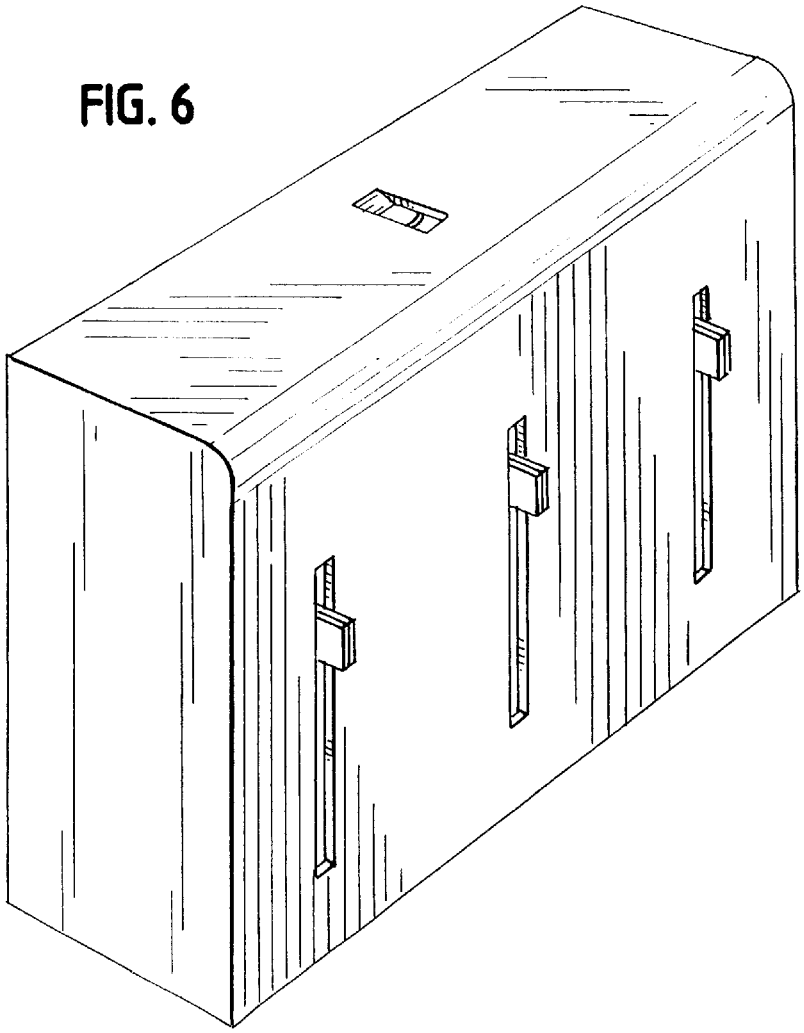
FIG. 6 depicts an alternate embodiment of the dispenser of FIG. 1.

Under an alternate embodiment of the invention (FIG. 6), a number of dispensers (FIG. 2) may be ganged in parallel. Where ganged together, a different dispenser may be devoted to each member of a household or may be dedicated to a different dental product.

Figure 7A:
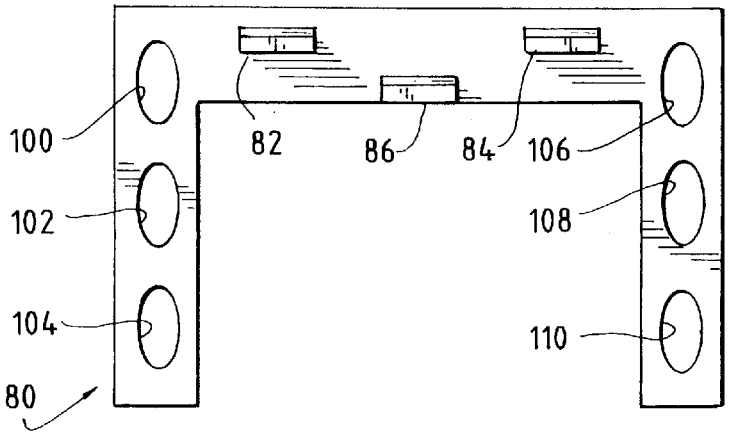
FIG. 7 depicts a toothbrush holder that may be used with the dispenser of FIG. 1.
Figure 7C:
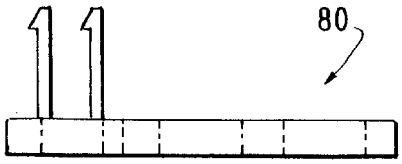
Figure 7B:
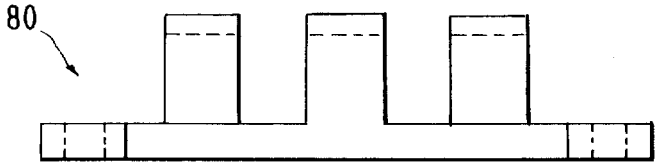

Under another embodiment (FIG. 7) a toothbrush holder 80 may be provided for attachment to the dispenser 10. Under the embodiment, a number of clips 82, 84, 86 may be provided to engage an equal number of apertures 88 (FIG. 4) of the frame 50. A number of toothbrush apertures 100, 102, 104, 106, 108, 110 may be provided in the holder 80 to receive toothbrushes.

A specific embodiment of an apparatus for dispensing toothpaste according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed is:

1. An apparatus for discharging toothpaste from a toothpaste tube under control of a user, such apparatus comprising:

a tube holder;

a tube receptacle disposed within a first end of the tube holder and adapted to accept a cap end of the toothpaste tube;

a set of nip rolls adapted to engage a body of the toothpaste tube and to urge toothpaste from a distal end of the toothpaste tube towards the cap end;

a wheeled trolley coupled to the nip rolls on a first end and engaging a guide channel of the tube holder on a second end and adapted to maintain an alignment of the nip rolls with respect to a centerline of the tooth paste tube as the nip rolls travel along a longitudinal axis of the toothpaste tube from the distal end to the cap end;

the wheeled trolley further including first and second parallel side rails; and wherein the first and second parallel side rails are laterally aligned and further comprise opposing apertures adapted to rotatably engage the nip rolls.

2. The apparatus for discharging toothpaste from the toothpaste tube as in claim 1 further comprising a user handle coupled to the wheeled trolley which allows the user to advance the nip rollers towards the cap end of the toothpaste tube and, thereby, discharge toothpaste.

3. The apparatus for discharging toothpaste from the toothpaste tube as in claim 1 further comprising a clamp adapted to accept and secure the distal end of the toothpaste tube.

4. The apparatus for discharging toothpaste from the toothpaste tube as in claim 1 wherein the guide channel further comprising first and second parallel plates aligned parallel to the longitudinal axis of the toothpaste tube.

5. The apparatus for discharging toothpaste from the toothpaste tube as in claim 4 wherein at least one of the parallel side rails further comprise a transverse end rail with a longitudinal axis of the transverse end rail parallel to the guide channel.

6. The apparatus for discharging toothpaste from the toothpaste tube as in claim 5 wherein the wheeled trolley further comprising a plurality of wheels coupled to the transverse end rail and disposed between the first and second parallel plates.

7. The apparatus for discharging toothpaste from the toothpaste tube as in claim 4 wherein the parallel side rails further comprises a transverse end rail coupled to a first end of each of the parallel end rails with a longitudinal axis of each of the transverse end rails parallel to the guide channel.

8. The apparatus for discharging toothpaste from the toothpaste tube as in claims 7 wherein the wheeled trolley further comprising a pair of trolley rollers rotatably coupled between transverse end rails and between the first and second parallel plates.

9. The apparatus for discharging toothpaste from the toothpaste tube as in claim 1 further comprising a plurality of toothpaste dispensers.

10. The apparatus for discharging toothpaste from the toothpaste tube as in claim 1 further comprising a toothbrush holder.

11. An apparatus for dispensing toothpaste from a toothpaste tube, such apparatus comprising:

first and second parallel and laterally aligned side rails;

first and second pairs of mutually parallel rollers rotatable disposed between the side rails, wherein the rollers of each of the first and second pairs of rollers are disposed adjacent one another and wherein a rotational axis of the first pairs of rollers reside in a first plane and a rotational axis of the second pair of rollers reside in a second plane perpendicular to the first plane;

first and second parallel, spaced-apart plates, each parallel to the plane defined by the rotational axis of the first set of rollers, wherein the first pair of rollers are disposed between the first and second spaced-apart plates;

a tube receptacle disposed at a first end of the first and second plates, with an axis of engagement of the tube receptacle disposed parallel to the plane formed by the rotational axis of the first pair of rollers, said tube receptacle containing an aperture for accepting a toothpaste dispensing end of the toothpaste tube, and wherein the second pair of rollers form nip rollers for urging toothpaste from the tube as the second pair of rollers are urged by a user from a distal end of the toothpaste tube towards the toothpaste dispensing end and wherein the first pair of rollers are adapted to maintain alignment of the second pair of rollers along a centerline of the toothpaste tube as the second pair of rollers move from the distal end of the toothpaste tube towards the toothpaste dispensing end of the toothpaste tube.

12. The apparatus for discharging toothpaste from the toothpaste tube as in claim 11 further comprising a user handle coupled to the first and second side rails which user handle is adapted to allow the user to advance the second pair of rollers towards the cap end of the toothpaste tube and, thereby, discharge toothpaste.

13. The apparatus for discharging toothpaste from the toothpaste tube as in claim 11 further comprising a clamp adapted to accept and secure the distal end of the toothpaste tube.

14. The apparatus for discharging toothpaste from the toothpaste tube as in claim 11 wherein the first and second parallel side rails further comprise a T-shaped plate.

15. The apparatus for discharging toothpaste from the toothpaste tube as in claim 11 wherein the first and second parallel side rails further comprise a L-shaped plate.

16. The apparatus for discharging toothpaste from the toothpaste tube as in claim 11 wherein the aperture for accepting the toothpaste dispensing end of the toothpaste tube further comprises a set of mating threads adapted to engage a matching set of threads on the toothpaste tube.

17. The apparatus for discharging toothpaste from the toothpaste tube as in claim 11 wherein the aperture for accepting the toothpaste dispensing end of the toothpaste tube further comprises a right-angle toothpaste conduit adapted to convey the toothpaste to a toothbrush of the user.

18. The apparatus for discharging toothpaste from the toothpaste tube as in claim 17 wherein the right-angle toothpaste conduit adapted to convey the toothpaste to a toothbrush of the user further comprises a cap adapted to preserve a freshness of the toothpaste.

* * * * *